US008707489B1

(12) United States Patent
Huhn

(10) Patent No.: US 8,707,489 B1
(45) Date of Patent: Apr. 29, 2014

(54) TOOL FOR REMOVING LIDS FROM IN-GROUND SERVICE BOXES

(76) Inventor: Raymond A. Huhn, Cherry Hill, NJ (US)

( * ) Notice: Subject to any disclaimer, the term of this patent is extended or adjusted under 35 U.S.C. 154(b) by 330 days.

(21) Appl. No.: 13/134,678

(22) Filed: Jun. 14, 2011

(51) Int. Cl.

| | |
|---|---|
| ***B25F 1/00*** | (2006.01) |
| ***B25B 13/06*** | (2006.01) |
| ***B25B 1/10*** | (2006.01) |
| ***B66F 15/00*** | (2006.01) |

(52) U.S. Cl.
USPC ..... 7/138; 81/177.5; 7/166

(58) Field of Classification Search
USPC ..... 7/138, 166, 151, 100; 81/177.5, 177.2; 157/1.3; D8/18, 26, 29, 31, 88
See application file for complete search history.

(56) References Cited

U.S. PATENT DOCUMENTS

| | | | | |
|---|---|---|---|---|
| 1,018,172 | A * | 2/1912 | Downs | 81/177.2 |
| 1,689,585 | A | 10/1928 | Haschart | |
| 1,766,845 | A | 6/1930 | Steele | |
| 1,933,384 | A * | 10/1933 | Moylan | 294/17 |
| 3,416,395 | A * | 12/1968 | Hanson | 81/177.5 |
| 4,039,140 | A * | 8/1977 | Pulliam | 254/25 |
| 5,685,207 | A * | 11/1997 | Hubert | 7/100 |
| D399,716 | S * | 10/1998 | Carr | D8/21 |
| 5,875,694 | A | 3/1999 | Graf | |
| D409,060 | S * | 5/1999 | Lucy | D8/24 |
| D434,290 | S | 11/2000 | McMullin | |
| 6,868,570 | B2 | 3/2005 | Sanders et al. | |

* cited by examiner

*Primary Examiner* — Hadi Shakeri
(74) *Attorney, Agent, or Firm* — Norman E. Lehrer

(57) ABSTRACT

A tool for removing lids from in-ground service boxes includes an elongated shaft having first and second ends, the first end including and open wrench socket. A first bar is rigidly connected to and extends from the second end of the shaft in a direction perpendicular to the axis of the shaft and ends in a pry tip. A second bar is also rigidly connected to and extends from the shaft at a position intermediate the two ends thereof. The said second bar extends in the same direction as and parallel to the first bar so that the device resembles the capital letter "F." The shaft, and the first and second bars lie in the same plane so that the pry tip and the distal end of the second bar are can be simultaneously inserted into spaced apart openings in the lid to rotate the lid.

5 Claims, 2 Drawing Sheets

TOOL FOR REMOVING LIDS FROM IN-GROUND SERVICE BOXES

BACKGROUND OF THE INVENTION

The present invention relates to a tool for removing the lids or covers from in-ground service boxes and for removing manhole covers and the like. More specifically, the invention relates to a multiuse manual tool that is particularly useful for removing such covers but which may have numerous other additional uses.

One of the common tasks performed by maintenance crews of utility companies is to open in-ground service boxes (also commonly referred to as vaults). The maintenance crews gain access to electrical cables, telephone wires, cable television cables and natural gas pipes through these vaults. The vaults are typically covered by lids that resemble manhole covers and that are secured by threads and by hold-down bolts. That is, the round cover has at least a partial external thread that cooperates with an internal thread on the mouth of the vault opening. The hold-down bolts prevent the cover from turning.

Today, maintenance crews out in the field open vault lids using customarily available tools. Such tools include a wrench socket and a socket wrench handle, as well as a crowbar, a claw hammer or even a screw driver. Maintenance workers typically arrive at a job site in a service truck, gather the customary tools from a tool box in the service truck. The workers search for a particular socket from among a set of sockets for turning different sizes of bolts and nuts. The workers then carry the tools to the vault lid in their pockets and hands. The amount of weight that a maintenance worker can carry is limited. Thus, maintenance crews do not typically carry an entire tool box to the vault lid.

Most of the lids of vaults for a particular utility company typically have the same size and type of hold-down bolts. For example, the hold-down bolts on the vault lids of a particular telephone company might have three-quarter-inch hexagonal bolt heads. Other companies, however, may utilize hold-down bolts with five-eighth-inch or one inch bolt heads.

Typically, a maintenance worker first kneels down to unscrew the hold-down bolts with a socket wrench. After the maintenance worker removes the hold-down bolts, he typically bends over to the ground and pries open the vault lid with a crowbar, claw hammer or screw driver. Then, still bent over, he grabs the lid with his hands and pulls it up and open. As this conventional method of removing vault lids involves bending over, grabbing the edge of the lid and pulling, it often results in back injuries.

Tools have been proposed in the past to assist such maintenance crews in removing lids. For example, U.S. Pat. No. 6,868,570 entitled "Tool for Opening Utility Vault Lids" describes a tool that includes an elongated handle with a socket wrench at one end and a hooked shaped pry tip on the other. While this prior art tool may be of some value, it is of no assistance with lids that also require them to be rotated in order to remove them.

As an added security feature, many more recent vault lids are also secured to the vault by a partial screw thread or bayonet arrangement. That is, when the circular lid is in place on the vault it must be rotated partially to be secured and to be removed from the same. Such lids include a pair of spaced apart recesses or depressions that are used to assist a worker in installing or removing the lid. The worker will normally use two different elongated objects and place one in each of the recesses. He or she will then securely hold the objects and rotate them around each other to turn the lid. This process is difficult to perform, particularly if soil or the like has entered the joint between the lid and the vault or if there has been even minor damage to the edge of the lid or vault.

Insofar as Applicant is aware, there are no tools available that can assist a worker in performing all of the steps necessary to install or remove a vault lid. While individual tools may be used, there is no single tool available that can accomplish the desired results.

There is, therefore, a need for a tool that can be used by a worker for installing and removing various types of vault lids and which is self contained and easy to utilize.

SUMMARY OF THE INVENTION

The present invention is designed to overcome the deficiencies of the prior art discussed above. It is an object of the present invention to provide a tool that is useful for removing lids from in-ground services boxes.

It is another object of the present invention to provide a tool that is useful for removing lids from in-ground services boxes and which is self contained so that other tools need not be used with the same.

It is a further object of the present invention to provide a tool that is useful for removing lids from in-ground services boxes and which is easy to carry and use.

In accordance with the illustrative embodiments demonstrating features and advantages of the present invention, there is provided a tool for aiding a worker in removing lids from in-ground service boxes that includes an elongated metal shaft having a first end and a second end and having a first axis. The first end includes an open wrench socket that is substantially axially aligned with the axis of the shaft. A first metal bar is rigidly connected to and extends from the second end of the shaft in a direction substantially perpendicular to the axis of the shaft and ends in a hook shape with a pry tip. A second metal bar is also rigidly connected to and extends from the shaft at a position intermediate the first and second ends thereof. The said second metal bar extends in the same direction as and substantially parallel to the first metal bar so that the device resembles the capital letter "F." The metal shaft, and the first and second metal bars lye in substantially the same plane so that the pry tip of the first metal bar and the distal end of the second metal bar are adapted to be simultaneously inserted into spaced apart openings in the lid in order to rotate the lid. A third metal bar is also connected to the shaft in axial alignment with the second bar but extends in the opposite direction. The third metal bar has a distal end with the ability to attach different sized wrench sockets thereto.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

DETAILED DESCRIPTION OF THE PREFERRED EMBODIMENT

Figure 1:
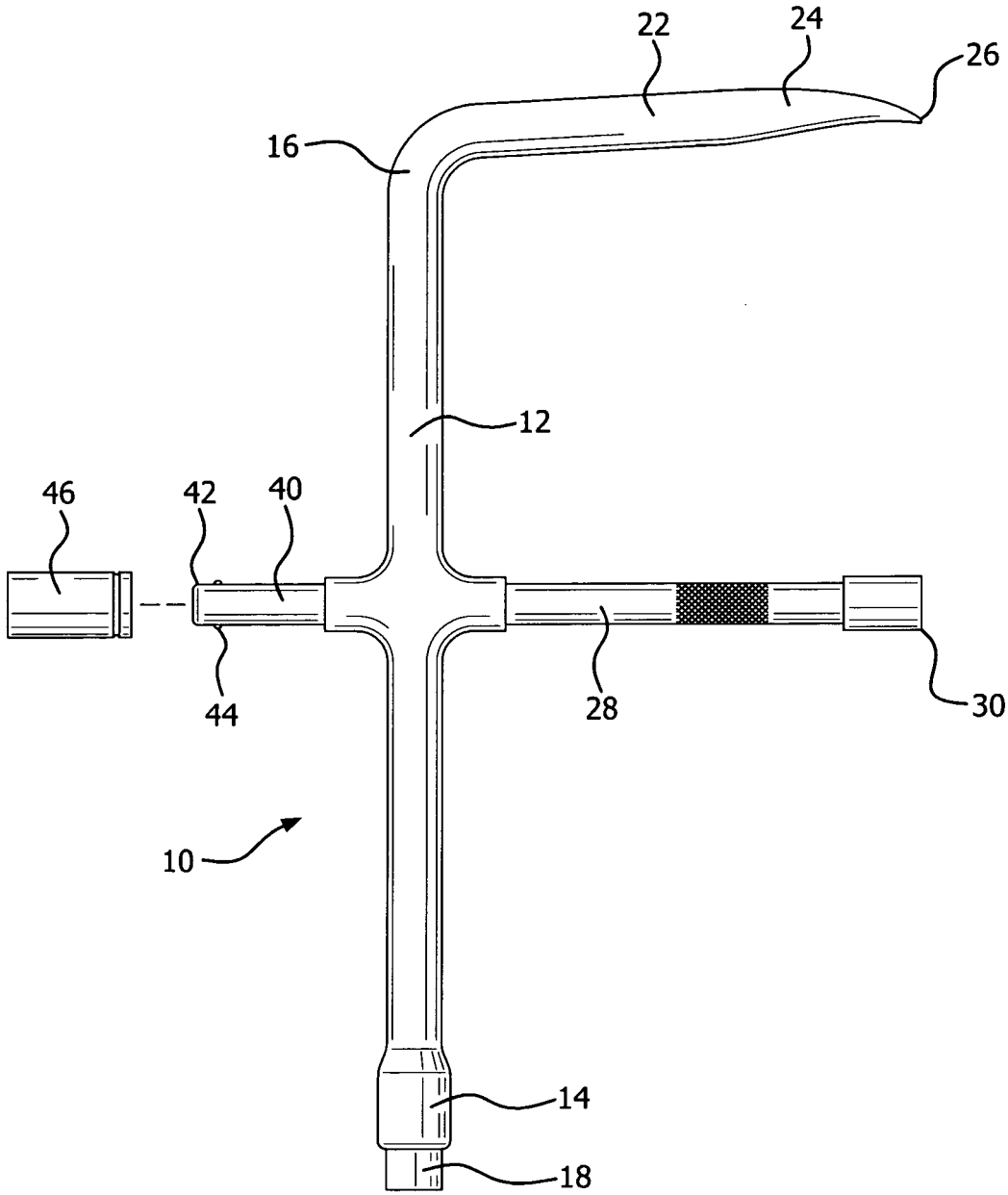
FIG. 1 is a front elevational view of a tool of the present invention for removing lids from in-ground service boxes but with a portion thereof exploded for clarity.

Referring now to the drawings in detail wherein like reference numerals have been used throughout the various figures to designate like elements, there is shown in FIGS. 1-4 a tool that is useful for removing lids from in-ground services boxes constructed in accordance with the principles of the present invention and designated generally at 10. The tool 10 is comprised essentially of an elongated metal shaft 12 having a first end 14 and a second end 16. The length of the shaft 12 may be, for example, approximately 24 to 30 inches. The overall length and size of the tool, however, may depend on the size of the in-ground service box and lid therefor with respect to which the tool is intended to be used.

The first end 14 of the shaft 12 includes an open wrench socket 18 which is in substantial axial alignment with the first axis or axis of the shaft 12. In the preferred embodiment of the invention, the socket 18 is a 3/8-inch hex socket. However, the size and shape of the socket 18 may differ. Again, this will depend on the size and shape of the bolt 20 (see FIGS. 2-4) adapted to be turned by the socket 18.

A first metal bar 22 is connected to the second end 16 of the shaft 12 and extends in a direction substantially perpendicular to the axis of the shaft 12. The distal end 24 of the bar 22 has a hook shape with a pry tip 26 thereon.

A second metal bar 28 is connected to the shaft 12 at approximately the midpoint between the ends 14 and 16. The second metal bar 28 extends from the shaft 12 in the same direction and substantially parallel to the first metal bar 22. The second metal bar 28 has a distal end 30 and has a length which is substantially equal to the length of the first metal bar 22.

The shaft 12 and first and second metal bars 22 and 28 lie in substantially the same plane. Thus, and as best seen in FIG. 1, the tool essentially resembles a capital "F."

Figure 3:
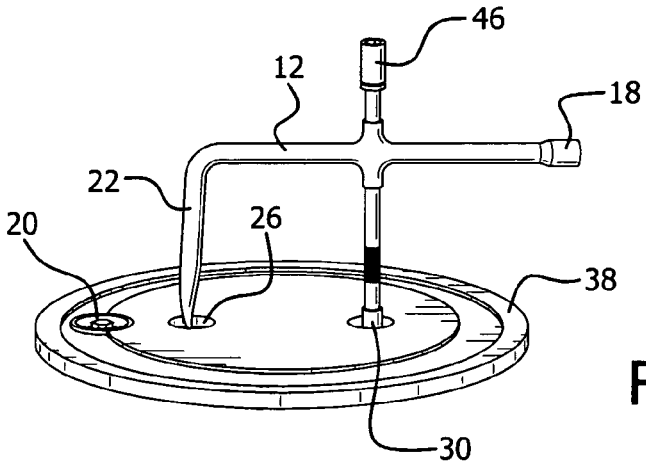
FIG. 3 is a perspective view similar to FIG. 2 but showing a second step in the use of the tool of the invention.

As shown most clearly in FIG. 3, the pry tip 26 and distal end 30 of the metal bars 22 and 28 are adapted to be simultaneously inserted into the spaced apart openings 32 and 34 of the service box or vault lid 38. This allows the tool 10 to be used to rotate the lid several degrees as is necessary in order to tighten or loosen the same from the vault for removal. The distance between the tip 26 and the distal end 30 of the first and second bars 22 and 28 is, of course, equal to the distance between the openings 32 and 34 which may be, for example, 12 to 16 inches. Obviously, a different tool would be needed for different size lids or covers.

A third metal bar 40 is also secured to the shaft 12 and is preferably in axial alignment with the bar 28. It extends, however, in the opposite direction to the other side of the shaft 12 although it is in essentially the same plane as the remaining parts of the tool 10. In the embodiment of the invention shown in the figures, the various parts of the tool 10 including the shaft 12 and the metal bars 22, 28 and 40 appear to be separate components that are connected together. It should be readily apparent, however, that all of these parts can be integrally formed as one piece.

The distal end 42 of the third bar 40 includes conventional spring loaded balls or detents 44 so that a plurality of different sized wrench sockets such as shown at 46 can be attached. This will make the tool 10 more versatile as it can then be used for various purposes.

Figure 2:
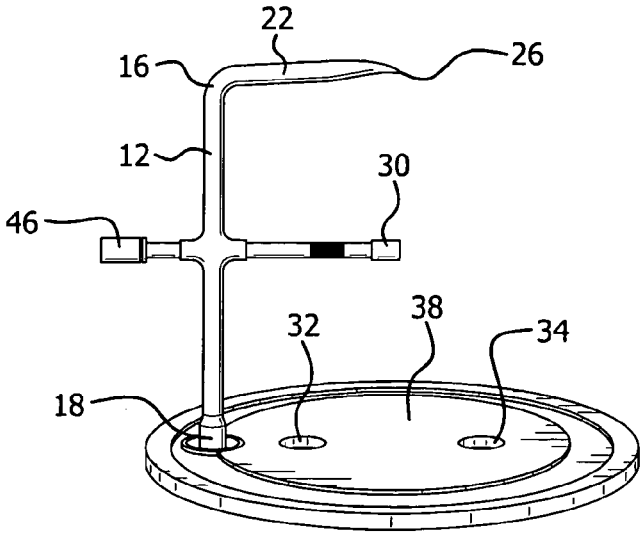
FIG. 2 is a view similar to FIG. 1 but showing the first step of the tool being used.
Figure 4:
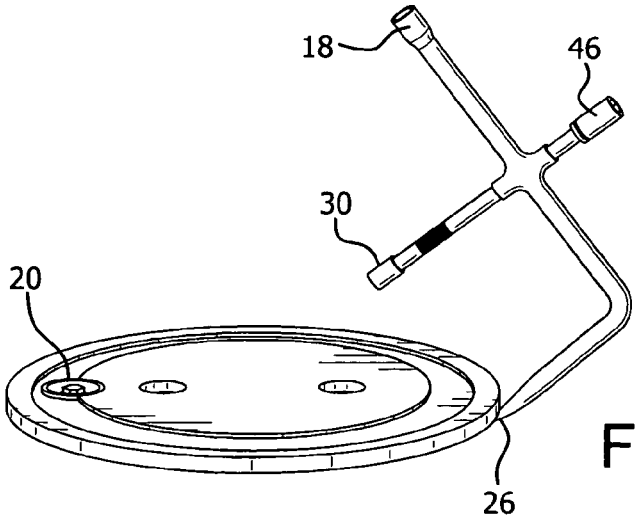
FIG. 4 is a perspective view showing the final step in the use of the tool of the invention.

The manner in which the tool 10 of the present invention is utilized should be readily apparent to those skilled in the art in viewing FIGS. 2, 3 and 4. Preliminarily, the socket 18 is used to loosen the bolt 20 in the lid 38. The tips 26 and 30 are then inserted into the openings 32 and 34 so that the lid can be rotated slightly in order to disengage the same from the vault. With the lid 30 loosened from the vault, the same can be pried upwardly and lifted out of the way utilizing the pry tip 26 of the tool.

The present invention may be embodied in other specific forms without departing from the spirit or essential attributes thereof and accordingly, reference should be made to the appended claims rather than to the foregoing specification as indicating the scope of the invention.

I claim:

1. A tool for removing lids from in-ground service boxes comprising:

an elongated metal shaft having a first end and a second end and having a first axis;

said first end including an open wrench socket, said socket being substantially axially aligned with said first axis;

a first metal bar rigidly connected to and extending from said second end of said shaft in only one direction substantially perpendicular to said axis of said shaft, the distal end of said first metal bar having a hook shape with a pry tip;

a second metal bar rigidly connected to and extending from said shaft at a position intermediate said first and second ends of said shaft; said second metal bar extending in the same direction as and substantially parallel to said first metal bar, said second metal bar having a distal end and having a length which is substantially equal to the length of said first metal bar, said metal shaft and said first and second metal bars lying in substantially the same plane and are connected together so as to resemble an F, whereby said pry tip of said first metal bar and said distal end of said second metal bar are adapted to be simultaneously inserted into spaced apart openings in said lid in order to rotate said lid, and a third metal bar connected to said shaft in a direction opposite to the direction of said first and second metal bars, said third metal bar having a distal end including means for attaching different sized wrench sockets thereto.

2. The tool for removing lids from in-ground service boxes of claim 1 wherein said second metal bar is located substantially half way between said first and second ends of said elongated metal shaft.

3. The tool for removing lids from in-ground service boxes of claim 1 wherein said wrench socket is a hexagonal wrench socket.

4. The tool for removing lids from in-ground service boxes of claim 1 wherein said third metal bar lies in substantially the same plane as said shaft and said first and second metal bars.

5. The tool for removing lids from in-ground service boxes of claim 1 wherein said third metal bar is in axial alignment with said second metal bar.

* * * * *